US005944432A

United States Patent [19]

Richardson

[11] Patent Number: 5,944,432

[45] Date of Patent: Aug. 31, 1999

[54] DEVICE FOR PROVIDING DISPOSABLE SANITARY KEYBOARD COVERS

[75] Inventor: Frank Lee Richardson, Glendale, Ariz.

[73] Assignee: AG Communication Systems Corporation, Phoenix, Ariz.

[21] Appl. No.: 08/988,340

[22] Filed: Oct. 23, 1997

[51] Int. Cl.[6] ..... B41J 11/62

[52] U.S. Cl. ..... 400/713; 400/714

[58] Field of Search ..... 400/713, 714, 400/715; 235/145 A, 145 R

[56] References Cited

U.S. PATENT DOCUMENTS

| | | | |
|---|---|---|---|
| 3,454,075 | 7/1969 | Weinstein | 160/238 |
| 4,758,712 | 7/1988 | Matone et al. | 235/145 R |
| 4,922,980 | 5/1990 | Parker | 400/713 |
| 5,021,638 | 6/1991 | Nopper et al. | 235/145 R |
| 5,370,468 | 12/1994 | Chern et al. | 400/713 |
| 5,551,497 | 9/1996 | Stanley | 400/714 |

*Primary Examiner*—Edgar Burr
*Assistant Examiner*—Anthony H. Nguyen
*Attorney, Agent, or Firm*—David J. Zwick; Gregory G. Hendricks

[57] ABSTRACT

An apparatus that dispenses disposable sanitary keyboard covers of a flexible transparent plastic film that is drawn across a key array and provides a sanitary cover that allows full use of the keyboard. When a subsequent user uses the keyboard, a new length of plastic film is drawn, and the old length of film is discarded. The apparatus includes a frame having a first tray holding a dispensing reel of plastic film at one end, and at the other end a second tray holding a take-up reel in a first embodiment, or rollers that direct the film to a slot in the outer wall of the tray with a cutting blade adjacent to the slot in a second embodiment.

6 Claims, 2 Drawing Sheets

DEVICE FOR PROVIDING DISPOSABLE SANITARY KEYBOARD COVERS

FIELD OF THE INVENTION

The present invention relates to sanitary protective covers, and more particularly to a device for providing disposable sanitary keyboard covers.

BACKGROUND OF THE INVENTION

There are many situations in which a computer keyboard is used by many people over the course of a workday or workweek. One such situation is in a laboratory or prototype environment with computer interfaces to a test system where high demand for access to valuable system resources is governed by a schedule. The test system may be scheduled, for example, for 8-hour periods by different engineers to allow them to test their work. It is possible, therefore, for an individual with, for example, a cold or the flu, to transmit the illness to a subsequent user of the test system through whatever germs that might be able to sustain themselves on the keyboard. It is desirable to have a supply of disposable covers for the keyboard such that each subsequent user will have an unused sanitary cover to aid in the hygienic prevention of the transmission of germs.

Keyboard covers are well known in the art (see, for example, U.S. Pat. No. 5,021,638). Most prior art keyboard covers are designed for long-term installation to protect the keyboard assembly from environmental contaminants. They are usually form-fitted to the specific key array, and are designed to withstand the rigors of long-term use. A problem with these prior art covers is that they are not designed to be single-use disposable and would be prohibitively expensive should they be used in this manner. Another problem is that the covers do not protect subsequent users of a keyboard from the transmission of germs a prior user may have deposited on the keyboard.

Accordingly, it is an object of the present invention to provide an apparatus that will dispense inexpensive sanitary single-use disposable keyboard covers.

Another object of the invention is for such keyboard covers to allow full use of the keyboard through the sanitary covers with minimal loss of the keyboard's "touch" or "feel."

SUMMARY OF THE INVENTION

The present invention provides an apparatus that dispenses plastic film that is drawn across a key array and provides a sanitary cover that allows full use of the keyboard. When a subsequent user uses the keyboard, a new length of plastic film is drawn, and the old length of film is discarded. The apparatus includes a frame upon which the keyboard assembly sits. At one end of the frame is a tray holding a reel of plastic film. At the other end of the frame is a second tray holding rollers that direct the film to a slot in the outer face of the tray. A cutting blade, such as a serrated cutting edge that may be found on plastic food wrap dispensing boxes, is attached to this outer face. A keyboard user would grasp the film at the cutting blade, draw out a sufficient length to cover the keyboard with new film, would pull the film against the cutting edge and cut off the excess film, and would then dispose of the cut film.

In an alternative embodiment, the second tray holds a take-up reel driven by a small crank arm. In this embodiment, the keyboard user would use the crank arm to draw out a sufficient length to cover the keyboard with new film, while rolling the exposed plastic film onto the take-up reel.

DETAILED DESCRIPTION OF THE PREFERRED EMBODIMENT

Figure 1:
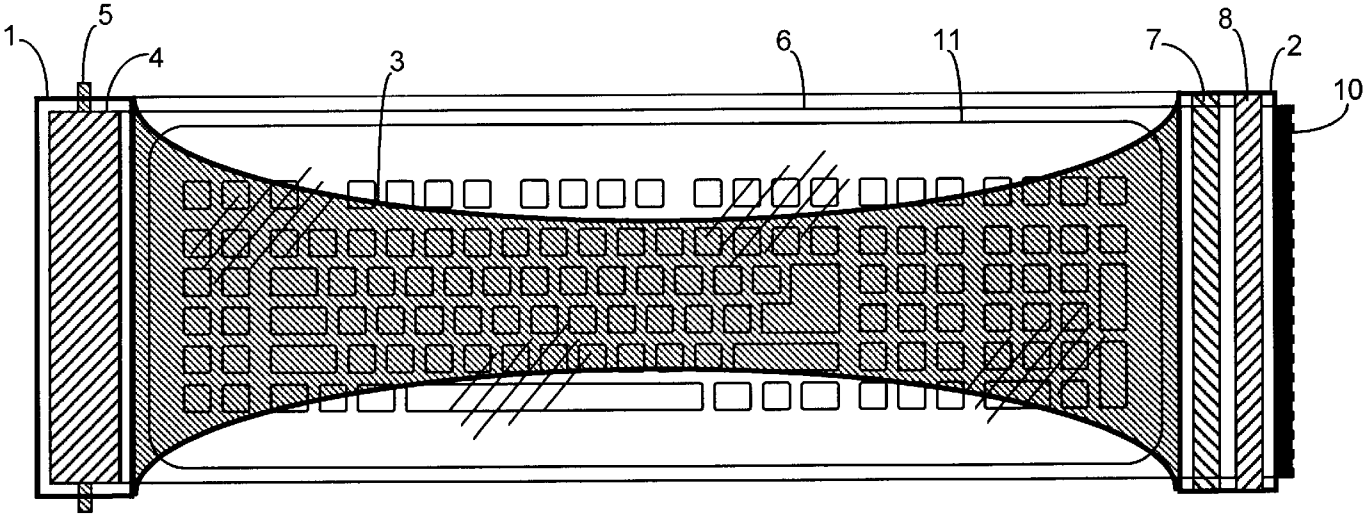
FIG. 1 is a top view of a first embodiment of the sanitary keyboard cover dispensing device of the present invention. A representative keyboard is shown in ghost image in position on the device.
Figure 1A:
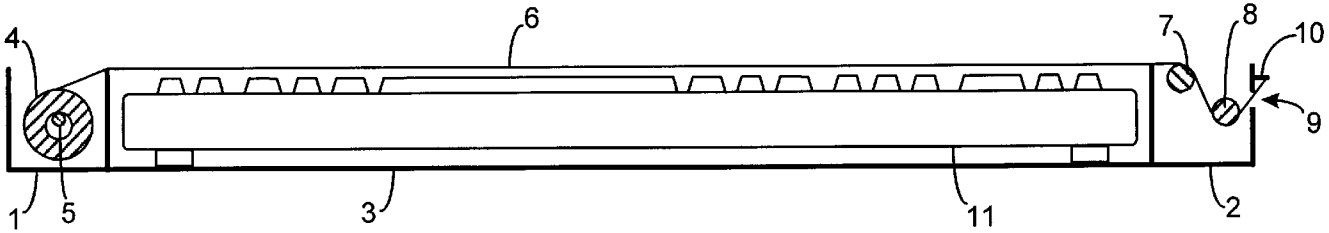
FIG. 1*a* is a cutaway side view of the first embodiment of the present invention depicted in FIG. 1.

FIGS. 1 and 1*a* illustrate a first embodiment of the sanitary keyboard cover dispensing device of the present invention. The device comprises a frame structure consisting of first tray 1 and second tray 2 connected to and separated by stretcher 3.

Film dispensing reel 4 is a roll of flexible elastomeric plastic film that is disposed in tray 1 and is axially supported by spindle 5, which is in turn supported by the end walls of tray 1 so as to hold dispensing reel 4 above the floor of tray 1. Spindle 5 may be supported by the end walls of tray 1, for example, in an arrangement where spindle 5 extends through two opposing holes in the end walls, the holes having a diameter slightly larger than the diameter of spindle 5, with the spindle being supported by the portion of the end walls forming the lower portion of each hole. Spindle 5 may be stopped from moving in an axial direction by, for example, machining an annular groove near each end of spindle 5 spaced apart such that when spindle 5 is axially centered in tray 1, the supporting portions of the end walls align with and extend into the annular grooves.

In operative position as shown, film 6 has been drawn from film dispensing reel 4 and extends the length of stretcher 3 so as to cover keyboard 11 that sits on stretcher 3. Film 6 continues over first roller 7, under second roller 8, and through slot 9, which has a length that is slightly wider than film 6. Rollers 7 and 8 are rotatably fastened between the end walls of tray 2 to guide film 6 through horizontal slot 9 such that film 6 may be drawn by pulling the film at a somewhat upward angle without impinging on the top or bottom walls of slot 9, nor cutting edge 10.

In operation, the length of film 6 between tray 1 and tray 2 that covers keyboard 11 is drawn through slot 9, at the same time drawing from reel 4 an unexposed sterile length of film over keyboard 11. The excess film extant of the device is brought upward and forward in a sweeping motion so as to impinge forcibly on cutting edge 10, which separates the excess film at the cutting edge. The excess film is then discarded. Preferably, cutting edge 10 is a serrated edge that "holds" film 6 after cutting so as to allow a user easy access to the end of the film when a new length is to be drawn. Other arrangements of cutting edge 10 will function equally as well. For example, cutting edge 10 may be fastened flat against the outer wall of tray 2 so as to partially extend into the top or the bottom of slot 9. When drawn and in operable position, film 6 should not be held taut and should lay across the key array of keyboard 11. Preferably, when all of film 6 is drawn from reel 4, a fresh dispensing reel 4 is placed in tray 1.

Figure 2:
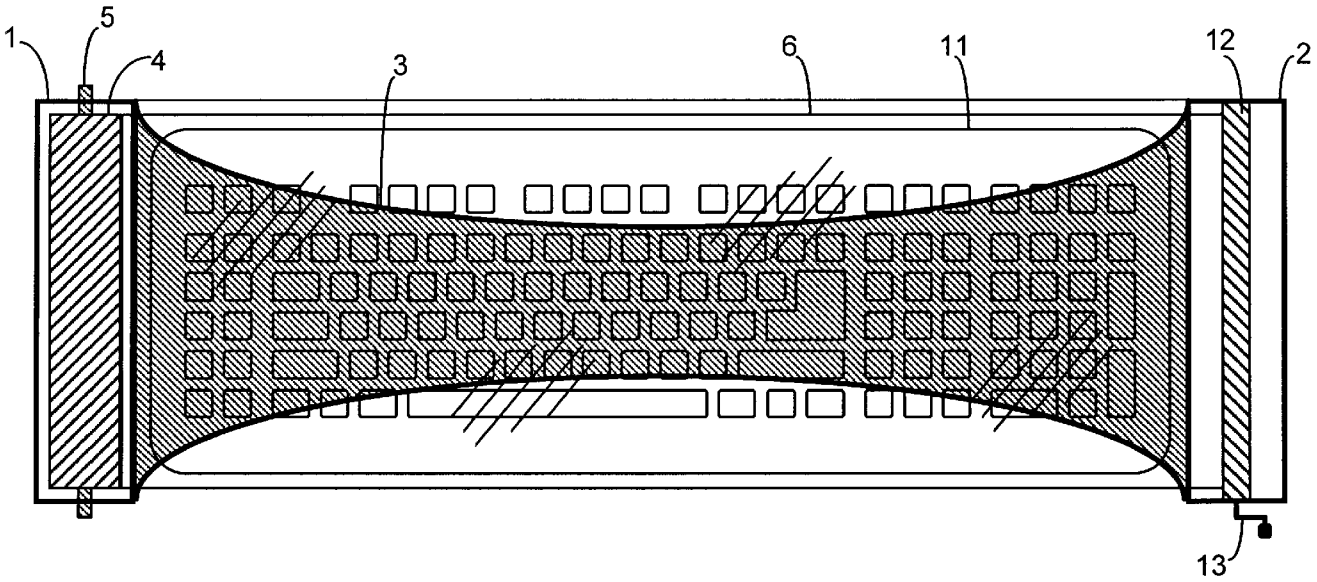
FIG. 2 is a top view of a second embodiment of the sanitary keyboard cover dispensing device of the present invention. A representative keyboard is shown in ghost image in position on the device.
Figure 2A:
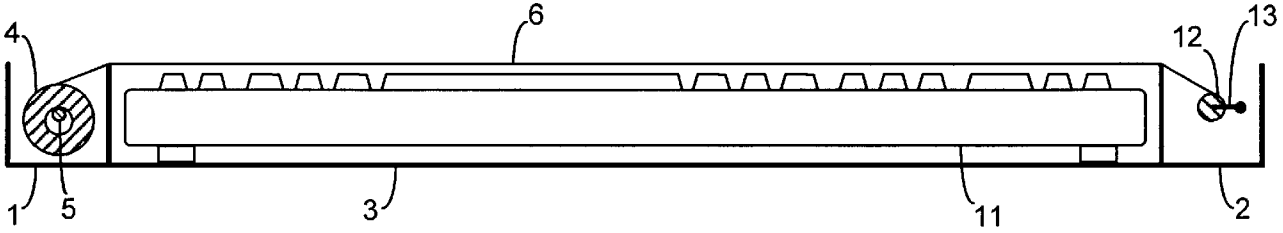
FIG. 2*a* is a cutaway side view of the second embodiment of the present invention depicted in FIG. 2.

FIGS. 2 and 2*a* show a second embodiment of the sanitary keyboard cover dispensing device of this present invention.

This embodiment is the same in all aspects as the first embodiment, with the exception of the elements involved with the excess film when a new length of film has been drawn over keyboard 11. In this embodiment, take-up reel 12 is rotatably and removably disposed between the end walls of tray 2. Crank arm 13 is axially attached to take-up reel 12 through an end wall of tray 2 and rotates take-up reel 12 such that exposed film is rolled onto take-up reel 12. In operation, a user rotates crank arm 13 sufficient to draw from reel 4 an unexposed sterile length of film over keyboard 11, while at the same time rolling the exposed film onto take-up reel 12. Preferably, when all of film 6 is rolled onto take-up reel 12, take-up reel 12 is removed from tray 2 and disposed of, and a fresh dispensing reel 4 and take-up reel 12 are placed in trays 1 and 2, respectively.

The length of stretcher 3 is determined by the length of keyboard 11 that is placed on stretcher 3. Preferably, stretcher 3 would be manufactured in the minimum number of configurations required to accommodate the most common keyboard dimensions, including keyboard footpad positions. Likewise, a similar analysis would determine the height of the inside walls of trays 1 and 2. Preferably, these walls are high enough so that when film 6 is drawn from reel 1, film 6 is suspended over the key array of keyboard 11 with a small clearance. This reduces friction between keyboard 11 and the underside of film 6 and aids in the ease of the drawing new film. The width of film 6, and therefore the length of trays 1 and. 2 will also be determined by the dimension of keyboard. 11. Preferably, the width of film 6 and the length of trays 1 and 2 would be manufactured in the minimum number of configurations required to accommodate the most common keyboard dimensions.

Film 6 is preferably a transparent flexible elastomeric plastic film on the order of 1 mil in thickness. The underside of film 6 preferably has a level of adhesion to the upper surfaces of the keys of keyboard 11 such that when a key is depressed through film 6, film 6 will slide laterally across keys adjacent to the depressed key such that these adjacent keys are not also depressed inadvertently through adhesion to film 6. The top side of film 6 preferably has a level of adhesion to human fingertips such that normal typing activities through film 6 are not hindered by excessive adhesion. Also, film 6 preferably provides an effective physical barrier to the transmission of germs between a keyboard user's fingers and the key array of keyboard 11.

While the inventive system has been particularly shown and described, it is not intended to be exhaustive nor to limit the invention to the embodiments disclosed. It will be apparent to those skilled in the art that modifications can be made to the present invention without departing from the scope and spirit thereof. It is intended that the scope of the invention be defined by the claims appended hereto and their equivalents.

What is claimed is:

1. A device for dispensing sanitary disposable film for use as a cover for a keyboard, comprising:

first and second trays attached to and separated by a stretcher, said keyboard disposed between said trays;

a dispensing reel disposed in said first tray and used to store a length of sanitary disposable film formed of a flexible transparent material;

a take-up reel disposed in said second tray for film which has been drawn the length of said keyboard;

drive means for said take-up reel to advance said film a length corresponding to the length of said keyboard.

2. A device for dispensing sanitary disposable film according to claim 1, wherein said first tray comprises:

opposing end walls with opposing holes therethrough;

a spindle disposed axially within said dispensing reel for supporting said dispensing reel, said spindle supported by the lower portions of the end walls forming said opposing holes.

3. A device for dispensing sanitary disposable film according to claim 1, wherein said drive means comprises a crank arm attached to one end of said take-up reel.

4. A device for dispensing sanitary disposable film for use as a cover for a keyboard, comprising:

first and second trays attached to and separated by a stretcher, said keyboard disposed between said trays;

a dispensing reel disposed in said first tray and used to store a length of sanitary disposable film formed of a flexible transparent material;

said second tray comprising an outer wall with a horizontal slot therethrough and a horizontal cutting edge attached to said outer wall for separating excess film from said device;

whereby said film that has been drawn the length of said keyboard is drawn through said slot a length corresponding to the length of said keyboard and said excess film extending outward from said device is separated from said device by manually forcibly impinging said film against said cutting edge so as to cut and separate said excess film from said device.

5. A device for dispensing sanitary disposable film according to claim 4, wherein said first tray comprises:

opposing end walls with opposing holes therethrough;

a spindle disposed axially within said dispensing reel for supporting said dispensing reel, said spindle supported by the lower portions of the end walls forming said opposing holes.

6. A device for dispensing sanitary disposable film according to claim 4, wherein said second tray further comprising opposing end walls with one or more rollers each rotatably connected to said end walls, said rollers used to guide said film through said slot.

* * * * *